US010808300B2

(12) United States Patent
Goto et al.

(10) Patent No.: US 10,808,300 B2
(45) Date of Patent: Oct. 20, 2020

(54) ALUMINUM ALLOY AND METHOD FOR MANUFACTURING ALUMINUM ALLOY

(71) Applicant: SUMITOMO ELECTRIC INDUSTRIES, LTD., Osaka-shi, Osaka (JP)

(72) Inventors: Kengo Goto, Osaka (JP); Akihisa Hosoe, Osaka (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 16/302,111

(22) PCT Filed: Mar. 15, 2017

(86) PCT No.: PCT/JP2017/010405
§ 371 (c)(1),
(2) Date: Nov. 16, 2018

(87) PCT Pub. No.: WO2017/199564
PCT Pub. Date: Nov. 23, 2017

(65) Prior Publication Data

US 2019/0153569 A1 May 23, 2019

(30) Foreign Application Priority Data

May 18, 2016 (JP) ..... 2016-099501

(51) Int. Cl.

| | |
|---|---|
| ***C22C 21/12*** | (2006.01) |
| ***C25D 3/66*** | (2006.01) |
| ***C25C 3/06*** | (2006.01) |
| ***C22C 21/00*** | (2006.01) |
| ***C22F 1/057*** | (2006.01) |

(52) U.S. Cl.
CPC ..... *C22C 21/12* (2013.01); *C22C 21/00* (2013.01); *C22F 1/057* (2013.01); *C25C 3/06* (2013.01); *C25D 3/66* (2013.01)

(58) Field of Classification Search
None
See application file for complete search history.

(56) References Cited

U.S. PATENT DOCUMENTS

| | | | |
|---|---|---|---|
| 2011/0308758 | A1 | 12/2011 | Chen et al. |
| 2012/0031766 | A1 | 2/2012 | Inoue et al. |
| 2013/0224589 | A1 | 8/2013 | Okamoto et al. |
| 2014/0272598 | A1 | 9/2014 | Okamoto |
| 2014/0346050 | A1 | 11/2014 | Sakaida et al. |
| 2017/0253949 | A1 | 9/2017 | Ijichi et al. |

FOREIGN PATENT DOCUMENTS

| | | | | |
|---|---|---|---|---|
| CN | 104053824 | A | | 9/2014 |
| JP | H04-143244 | A | | 5/1992 |
| JP | 2008150653 | | * | 7/2008 |
| JP | 2009-19223 | A | | 1/2009 |
| JP | 2009-173977 | A | | 8/2009 |
| JP | 2009-197318 | A | | 9/2009 |
| JP | 2015-140441 | A | | 8/2015 |
| JP | 2015-209558 | A | | 11/2015 |
| WO | WO-2012/063920 | A1 | | 5/2012 |
| WO | WO-2013/062026 | A1 | | 5/2013 |
| WO | WO 2016/039380 | A1 | | 3/2016 |

* cited by examiner

*Primary Examiner* — Daniel J. Schleis
(74) *Attorney, Agent, or Firm* — Faegre Drinker Biddle & Reath LLP

(57) ABSTRACT

An aluminum alloy contains at least one additive element selected from the group consisting of Zr, Cu, Cr, and Zn in an amount of 0.010% by mass or more and 8.0% by mass or less, and C in an amount of 0.01% by mass or more and 10.0% by mass or less.

3 Claims, No Drawings

ALUMINUM ALLOY AND METHOD FOR MANUFACTURING ALUMINUM ALLOY

TECHNICAL FIELD

The present invention relates to an aluminum alloy and a method for manufacturing an aluminum alloy.

The present application claims priority from Japanese Patent Application No. 2016-099501 filed on May 18, 2016, and the entire contents of the Japanese patent application are incorporated herein by reference.

BACKGROUND ART

Aluminum has many good characteristics such as electrical conductivity, corrosion resistance, light weight, and non-toxicity and is widely used in plating of, for example, metal products. However, since aluminum has low strength, it is necessary to alloy aluminum by adding elements such as Cu, Mg, and Mn when used in applications that require strength, such as structural materials.

For example, Japanese Unexamined Patent Application Publication No. 2009-019223 (PTL 1) describes an aluminum alloy sheet that contains Si in an amount of 0.05% to 1.0% by mass, Fe in an amount of 0.05% to 1.0% by mass, Mn in an amount of 0.5% to 2.0% by mass, Cu in an amount of 0.05% to 0.5% by mass, and the balance being Al and unavoidable impurities. The aluminum alloy sheet described in PTL 1 is in a cold-rolled state, includes a matrix that contains dissolved Mn in an amount of 40% or more of the Mn content, and has a yield strength of 130 MPa or more and a tensile strength of 140 MPa or more at 200° C.

Japanese Unexamined Patent Application Publication No. 2009-197318 (PTL 2) describes an Al—Zr—Mn alloy plating bath. According to the Al—Zr—Mn alloy plating bath described in PTL 2, a smooth, dense Al—Zr—Mn alloy plating film can be obtained.

CITATION LIST

Patent Literature

PTL 1: Japanese Unexamined Patent Application Publication No. 2009-019223

PTL 2: Japanese Unexamined Patent Application Publication No. 2009-197318

SUMMARY OF INVENTION

An aluminum alloy according to the present invention is an aluminum alloy containing at least one additive element selected from the group consisting of Zr, Cu, Cr, and Zn in an amount of 0.010% by mass or more and 8.0% by mass or less, and C in an amount of 0.01% by mass or more and 10.0% by mass or less.

DESCRIPTION OF EMBODIMENTS

Technical Problem

Various aluminum alloys are previously known as described in the Background Art. However, corrosion resistance of any of the aluminum alloys is decreased by influence of the additive elements. In addition, when aluminum alloys are subjected to heat treatment at a high temperature, intermetallic compounds are formed, resulting in a problem of a decrease in the strength. Therefore, it is difficult to use existing aluminum alloys in a high-temperature region.

Aluminum alloys can be produced by electroplating using a molten salt. However, regarding aluminum alloys produced by electroplating using a molten salt, there are many unclear points in relation to properties with respect to heat treatment. In view of this, the inventors of the present invention produced an Al—Zr alloy by electroplating using a molten salt and examined a change in physical properties with respect to heat treatment. Specifically, $ZrCl_4$ was added to an $AlCl_3$-EMIC ionic liquid in a concentration of 0.001 mol/L to 0.1 mol/L. and an Al—Zr alloy was deposited at a current density in a range of 1 mA/cm$^2$ to 100 mA/cm. The resulting alloy foil was subjected to heat treatment at 500° C. or higher. The results showed that physical properties such as tensile strength and electrical resistivity significantly decreased.

The electrolytic Al—Zr alloy foil subjected to heat treatment at 500° C. or higher was observed in detail. According to the results, it was found that voids were formed in a section, and surface oxidation rapidly proceeded. The reason for this is believed to be as follows. When an intermetallic compound of Al and Zr deposits at 500° C. or higher, the volume of an Al—Zr alloy phase, which has originally deposited as an amorphous phase, significantly changes, resulting in the formation of voids. Consequently, oxidation easily proceeds in the intennetallic compound phase exposed at that time. Therefore, the electrolytic Al—Zr alloy foil is also believed to have low high-temperature resistance.

In view of the problems described above, an object of the present invention is to provide an aluminum alloy having a small decrease in tensile strength even after heat treatment is conducted at a high temperature.

Advantageous Effects of the Present Disclosure

The present invention can provide an aluminum alloy having a small decrease in tensile strength even after heat treatment is conducted at a high temperature.

DESCRIPTION OF EMBODIMENTS OF THE PRESENT INVENTION

First, embodiments of the present invention will be listed and described.

(1) An aluminum alloy according to an embodiment of the present invention is an aluminum alloy containing at least one additive element selected from the group consisting of Zr, Cu, Cr, and Zn in an amount of 0.010% by mass or more and 8.0% by mass or less, and C in an amount of 0.01% by mass or more and 10.0% by mass or less.

According to the embodiment of the invention described in (1), it is possible to provide an aluminum alloy having a small decrease in tensile strength even after heat treatment is conducted at a high temperature.

(2) When the aluminum alloy according to (1) is subjected to heat treatment at 600° C. for one hour, a rate of decrease in tensile strength after the heat treatment is preferably within 20%.

According to the embodiment of the invention described in (2), it is possible to provide an aluminum alloy whose physical properties do not substantially change even when heat treatment is conducted at a high temperature of about 600° C. and the temperature is returned to room temperature.

(3) The aluminum alloy according to (1) or (2) preferably has a surface having an arithmetic mean roughness Ra of 0.20 μm or less.

According to the embodiment of the invention described in (3), an aluminum alloy having a smooth surface can be provided.

(4) The aluminum alloy according to any one of (1) to (3) preferably has a foil shape having a thickness of 3 μm or more and 40 μm or less.

According to the embodiment of the invention described in (4), it is possible to provide an aluminum alloy foil having a small decrease in tensile strength after heat treatment even when the heat treatment is conducted at a high temperature of about 600° C.

(5) The aluminum alloy according to any one of (1) to (3) preferably has a three-dimensional network structure.

According to the embodiment of the invention described in (5), it is possible to provide an aluminum alloy having a three-dimensional network structure and having a small decrease in tensile strength after heat treatment even when the heat treatment is conducted at a high temperature of about 600° C.

(6) A method for manufacturing an aluminum alloy according to an embodiment of the present invention is a method for manufacturing the aluminum alloy according to (1), the method including an electrolysis step of conducting electroplating with a molten salt by using a molten salt bath prepared by adding an aluminum halide, an additive element-containing compound that contains at least one additive element selected from the group consisting of Zr, Cu, Cr, and Zn, and a smoothing agent to the molten salt to thereby electrodeposit an aluminum alloy on a surface of a substrate.

In the method, the smoothening agent is at least one selected from the group consisting of 1,10-phenanthroline chloride monohydrate, 1,10-phenanthroline monohydrate, and 1,10-phenanthroline, and a concentration of the smoothing agent in the molten salt bath is a concentration at which a concentration of C in the aluminum alloy is 0.01% by mass or more and 10.0% by mass or less.

According to the embodiment of the invention described in (6), it is possible to provide a method for manufacturing an aluminum alloy, the method capable of manufacturing an aluminum alloy having a small decrease in tensile strength and after heat treatment even when the heat treatment is conducted at a high temperature.

(7) The method for manufacturing the aluminum alloy according to (6) preferably further includes a heat treatment step of subjecting the aluminum alloy electrodeposited on the surface of the substrate to heat treatment at a temperature of 250° C. or higher and 500° C. or lower.

According to the embodiment of the invention described in (7), it is possible to provide an aluminum alloy having improved tensile strength after heat treatment at a high temperature.

(8) In the method for manufacturing the aluminum alloy according to (6) or (7), the molten salt preferably contains at least one molten salt-forming compound selected from the group consisting of alkylimidazolium halides, alkylpyridinium halides, and urea compounds, and a mixing ratio of the aluminum halide to the molten salt-forming compound is preferably in a range of 1:1 to 3:1 on a molar basis.

According to the embodiment of the invention described in (8), the aluminum alloy can be manufactured by using a molten salt at a relatively low temperature.

DETAILS OF EMBODIMENTS OF THE PRESENT INVENTION

Specific examples of an aluminum alloy according to an embodiment of the present invention and a method for manufacturing the aluminum alloy will be described below. The present invention is not limited to the examples. The scope of the present invention is defined by the appended claims and is intended to cover all modifications within the meaning and scope equivalent to those of the claims.

<Aluminum Alloy>

An aluminum alloy according to an embodiment of the present invention is an aluminum alloy containing at least one additive element selected from the group consisting of Zr, Cu, Cr, and Zn in an amount of 0.010% by mass or more and 8.0% by mass or less and C in an amount of 0.01% by mass or more and 10.0% by mass or less.

Since the aluminum alloy contains at least one additive element selected from the group consisting of Zr, Cu, Cr, and Zn, the aluminum alloy has improved tensile strength compared with elemental aluminum. When the content of the additive element in the aluminum alloy is less than 0.010% by mass, the effect of improving tensile strength is not obtained. When the content of the additive element exceeds 8.0% by mass, the aluminum alloy becomes brittle. From the above viewpoints, the content of the additive element in the aluminum alloy is more preferably 0.050% by mass or more and 5.0% by mass or less, and still more preferably 0.1% by mass or more and 4.0% by mass or less.

Since the aluminum alloy contains carbon (C), the aluminum alloy has a small decrease in tensile strength after heat treatment at a high temperature. When the content of C in the aluminum alloy is less than 0.01% by mass, tensile strength significantly decreases after heat treatment is conducted at a high temperature of about 600° C. When the content of C in the aluminum alloy exceeds 10.0% by mass, an amorphous portion increases in the resulting coating film, and the aluminum alloy becomes brittle. From the above viewpoints, the content of C in the aluminum alloy is more preferably 0.05% by mass or more and 5.0% by mass or less, and still more preferably 0.2% by mass or more and 3.5% by mass or less.

Note that in the aluminum alloy according to an embodiment of the present invention, carbon may be contained as elemental carbon or as a carbide with aluminum or the additive element.

In the aluminum alloy, Zr is alloyed with aluminum, and the recrystallization temperature can be thereby increased without impairing electrical conductivity. Copper (Cu) is alloyed with aluminum, and strength of aluminum can be thereby significantly improved, which is known as duralumin. Chromium (Cr) is alloyed with aluminum, and durability such as wear resistance can be thereby improved. Zinc (Zn) can significantly improve strength of aluminum as in the case of Cu.

The aluminum alloy according to an embodiment of the present invention contains C. Accordingly, when heat treatment is conducted, for example, at 350° C. for three hours, tensile strength tends to improve, compared with the state before the heat treatment. Furthermore, even when heat treatment is conducted at 600° C. for one hour, a rate of decrease in tensile strength after the heat treatment can be within 20%. Therefore, the aluminum alloy according to an embodiment of the present invention can be used even in an environment in which the aluminum alloy is exposed to a high temperature of about 600° C.

From the viewpoint of suitably using the aluminum porous alloy in an environment in which the aluminum porous alloy is exposed to a high temperature, in the case where heat treatment is conducted at 600° C. for one hour, the smaller the rate of decrease in tensile strength, the more preferable. For this purpose, the type and the content of the additive element, and the content of C are appropriately adjusted.

The tensile strength of the aluminum alloy can be measured with a tensile tester. Regarding the shape of a specimen, the width may be 20 mm, the length may be 100 mm, and a gauge length (the length excluding holding portions) when both ends of the specimen are held with a holding jig may be 60 mm.

The aluminum alloy according to an embodiment of the present invention preferably has a surface having an arithmetic mean roughness Ra of 0.20 μm or less. From the viewpoint of obtaining a smooth aluminum alloy, the smaller the arithmetic mean roughness Ra, the more preferable. The arithmetic mean roughness Ra is more preferably 0.15 μm or less, and still more preferably 0.10 μm or less.

The arithmetic mean roughness Ra of the aluminum alloy can be measured with a laser microscope.

The shape of the aluminum alloy according to an embodiment of the present invention is not particularly limited. For example, the aluminum alloy preferably has a foil shape having a thickness of 3 μm or more and 40 μm or less. In this case, the aluminum alloy can be preferably used in applications in which the aluminum alloy is exposed to a high-temperature environment, such as a step of drying a current collector for a lithium ion battery, while suppressing a decrease in tensile strength.

The aluminum alloy preferably has a porous shape having a three-dimensional network structure. In this case, the aluminum alloy can be preferably used in applications such as electrodes for fuel cells, filters, and catalyst supports, all of which are used in a high-temperature environment, while suppressing a decrease in tensile strength.

The aluminum alloy according to an embodiment of the present invention has better oxidation resistance than existing carbon-free aluminum alloys. For example, when an Al—Zr alloy containing Zr in an amount of 4.0% by mass is subjected to heat treatment at 600° C. for one hour, the color of the Al—Zr alloy changes to brown. In contrast, when an Al—Zr—C alloy containing Zr in an amount of 4.0% by mass and C in an amount of 0.2% by mass is subjected to heat treatment under the same conditions, the color of the Al—Zr—C alloy does not change to brown, and a metallic luster can be maintained. Incorporation of carbon not only enables the volume change to be suppressed when an alloy phase is formed by heat treatment, but also prevents the alloy phase from being exposed on the outermost surface to improve high-temperature resistance.

<Method for Manufacturing Aluminum Alloy>

A method for manufacturing an aluminum alloy according to an embodiment of the present invention includes an electrolysis step of conducting molten salt electrolysis by using a molten salt bath prepared by adding an aluminum halide, an additive element-containing compound, and a smoothing agent to a molten salt to thereby electrodeposit an aluminum alloy on a surface of a substrate. Preferably, the method for manufacturing an aluminum alloy further includes a heat treatment step of subjecting the aluminum alloy electrodeposited on the surface of the substrate to heat treatment at a temperature of 250° C. or higher and 500° C. or lower. Each of the steps and configurations will be described in detail below.

—Electrolysis Step—

The electrolysis step is a step of conducting molten salt electrolysis by using a molten salt bath to thereby electrodeposit an aluminum alloy on a surface of a substrate.

In order to electrodeposit an aluminum alloy on a surface of a substrate in a molten salt bath, for example, the substrate and aluminum are disposed in the molten salt bath so as to face each other, the substrate is connected on the cathode side of a rectifier, the aluminum is connected to the anode side of the rectifier, and a voltage is applied between the electrodes. In order to efficiently electrodeposit aluminum on the surface of the substrate, it is preferable to use aluminum that has a surface having a larger area than the substrate, the surface facing the substrate.

The molten salt bath is one prepared by adding an aluminum halide, an additive element-containing compound, and a smoothing agent to a molten salt. The molten salt bath may contain other components as unavoidable impurities or may intentionally contain other components within a range that does not impair the advantageous effects of the method for manufacturing an aluminum alloy according to an embodiment of the present invention.

The electrolysis step is preferably conducted such that a current density is 10 $mA/cm^2$ or more and 60 $mA/cm^2$ or less. A current density within the above range can provide an aluminum alloy having better smoothness. The current density is preferably 20 $mA/cm^2$ or more and 50 $mA/cm^2$ or less, and still more preferably 30 $mA/cm^2$ or more and 40 $mA/cm^2$ or less.

The temperature of the molten salt bath in the electrolysis step is appropriately adjusted in accordance with the type of molten salt bath used. For example, when at least one molten salt-forming compound selected from the group consisting of alkylimidazolium halides, alkylpyridinium halides, and urea compounds is used as the molten salt, the electrolysis step is preferably conducted while the temperature of the molten salt bath is adjusted to 15° C. or higher and 110° C. or lower. When the temperature of the molten salt bath is 15° C. or higher, the viscosity of the molten salt bath can be sufficiently decreased to improve electrodeposition efficiency of the aluminum alloy. When the temperature of the molten salt bath is 110° C. or lower, volatilization of the aluminum halide can be suppressed. The temperature of the molten salt bath is more preferably 30° C. or higher and 80° C. or lower, and still more preferably 40° C. or higher and 70° C. or lower.

In the electrolysis step, the molten salt bath may be stirred, if necessary.

(Molten Salt)

Known molten salts capable of subjecting aluminum to molten salt electrolysis can be used as the molten salts.

For example, chloride molten salts and fluoride molten salts can be used.

Examples of the chloride molten salts that can be used include KCl, NaCl, $CaCl_2$, LiCl, RbCl, CsCl, $SrCl_2$, $BaCl_2$, $MgCl_2$, and eutectic salts thereof. Examples of the fluoride molten salts that can be used include LiF, NaF, KF, RbF, CsF, $MgF_2$, $CaF_2$, $SrF_2$, $BaF_2$, and eutectic salts thereof.

Among the above molten salts, KCl, NaCl, and $CaCl_2$ are preferably used from the viewpoint that they are cheap and easily available.

From the viewpoint of decreasing the melting point, the molten salt preferably contains at least one molten salt-forming compound selected from the group consisting of alkylimidazolium halides, alkylpyridinium halides, and urea compounds. The molten salt-forming compound that can be suitably used is a compound that forms a molten salt at about 110° C. or lower when mixed with an aluminum halide.

Examples of the alkylimidazolium halides include imidazolium chlorides having alkyl groups (having 1 to 5 carbon atoms) at the 1- and 3-positions, imidazolium chlorides having alkyl groups (having 1 to 5 carbon atoms) at the 1-, 2-, and 3-positions, and imidazolium iodides having alkyl groups (having 1 to 5 carbon atoms) at the 1- and 3-positions.

More specifically, examples thereof include 1-ethyl-3-methylimidazolium chloride (EMIC), 1-butyl-3-methylimidazolium chloride (BMIC), and 1-methyl-3-propylimidazolium chloride (MPIC). Among these, 1-ethyl-3-methylimidazolium chloride (EMIC) can be most preferably used.

Examples of the alkylpyridinium halides include 1-butylpyridinium chloride (BPC), 1-ethylpyridinium chloride (EPC), and 1-butyl-3-methylpyridinium chloride (BMPC). Among these, 1-butylpyridinium chloride is most preferable.

The urea compounds cover urea and derivatives thereof. For example, compounds represented by formula (I) below can be preferably used.

[Chem. 1]

Formula (1)

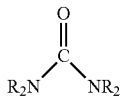

In formula (1), R each represent a hydrogen atom, an alkyl group having 1 to 6 carbon atoms, or a phenyl group, and R may be the same or different from each other.

Among the above urea compounds, urea and dimethylurea can be particularly preferably used.

When the molten salt-forming compound is used, a mixing ratio of the aluminum halide to the molten salt-forming compound may be controlled in a range of 1:1 to 3:1 on a molar basis. In this case, a molten salt bath suitable for electrodepositing an aluminum alloy on a surface of the substrate is obtained.

(Aluminum Halide)

Examples of the aluminum halide include aluminum chloride ($AlCl_3$), aluminum bromide, ($AlBr_3$), and aluminum iodide ($AlI_3$). Among these, aluminum chloride is most preferable.

(Additive Element-Containing Compound)

The additive element-containing compound may be any compound that contains elements contained in a desired aluminum alloy. For example, in the case of manufacturing an Al—Zr alloy, $ZrCl_4$ or the like can be used. In the case of manufacturing an Al—Cu alloy. $CuCl_2$ or the like can be used. In the case of manufacturing an Al—Cr alloy. $CrCl_3$ or the like can be used. In the case of manufacturing an Al—Zn alloy, $ZnCl_2$ or the like can be used.

The amount of the additive element-containing compound added to the molten salt is appropriately adjusted in accordance with the content of additive elements in the aluminum alloy. For example, the additive element-containing compound is added to the molten salt such that the concentration in the molten salt bath is about 0.001 mol/L or more and 0.1 mol/L or less.

(Smoothing Agent)

The smoothing agent is at least one selected from the group consisting of 1,10-phenanthroline chloride monohydrate, 1,10-phenanthroline monohydrate, and 1,10-phenanthroline. These smoothing agents are incorporated into an aluminum alloy electrodeposited on a surface of a substrate and thereby function as a carbon source contained in the aluminum alloy according to an embodiment of the present invention. Furthermore, the smoothing agents are incorporated into an aluminum alloy electrodeposited on a surface of a substrate to thereby provide a smooth, mirror-surface aluminum alloy.

The concentration of the smoothing agent in the molten salt bath is determined such that the concentration of C in the aluminum alloy electrodeposited on a surface of a substrate is 0.01% by mass or more and 10.0% by mass or less and may be changed as required in accordance with the type of smoothing agent used.

When 1,10-phenanthroline chloride monohydrate is used as the smoothing agent, the concentration of the smoothing agent in the molten salt bath is preferably 0.03 g/L or more and 7.5 g/L or less, more preferably 0.1 g/L or more and 5.0 g/L or less, and still more preferably 0.3 g/L or more and 1.5 g/L or less.

When 1,10-phenanthroline monohydrate is used as the smoothing agent, the concentration of the smoothing agent in the molten salt bath is preferably 0.05 g/L or more and 7.5 g/L or less, more preferably 0.1 g/L or more and 2.0 g/L or less, and still more preferably 0.3 g/L or more and 1.0 g/L or less.

When 1,10-phenanthroline is used as the smoothing agent, the concentration of the smoothing agent in the molten salt bath is preferably 0.1 g/l, or more and 10 g/L or less, more preferably 0.25 g/L or more and 7 g/L or less, and still more preferably 2.5 g/L or more and 5 g/L or less.

(Substrate)

The substrate is not particularly limited as long as the substrate needs to have an aluminum alloy on a surface thereof. For example, a copper plate, a steel strip, a copper wire, a steel wire, or a resin subjected to conductivity-imparting treatment can be used as the substrate. As the resin subjected to conductivity-imparting treatment, for example, a resin such as a polyurethane, melamine resin, polypropylene, or polyethylene that has been subjected to conductivity-imparting treatment can be used.

The resin serving as the substrate may have any shape. The use of a resin molded body having a three-dimensional network structure finally enables production of an aluminum alloy having a three-dimensional network structure and exhibiting good characteristics for use in various filters, catalyst supports, electrodes for batteries, and the like. Furthermore, the use of a resin having a nonwoven fabric shape also enables an aluminum alloy having a porous structure to be finally produced. The aluminum alloy having a nonwoven fabric shape and thus produced can also be suitably used in various filters, catalyst supports, electrodes for batteries, and the like.

—Heat Treatment Step—

The heat treatment step is a step of subjecting the aluminum alloy electrodeposited on the surface of the substrate to heat treatment at a temperature of 250° C. or higher and 500° C. or lower.

The aluminum alloy electrodeposited on the surface of the substrate in the electrolysis step contains C derived from the smoothing agent and thus is an aluminum alloy having a small decrease in tensile strength even after heat treatment is conducted at about 600° C. Furthermore, in an environment at about 250° C. or higher and 500° C. or lower, tensile strength tends to rather improve.

According to the method for manufacturing an aluminum alloy according to an embodiment of the present invention, structure control can be achieved by adjusting the current density and the temperature in molten salt electrolysis, and an aluminum alloy having a denser and finer structure than thermally sprayed aluminum alloys can be manufactured. Furthermore, it is possible to obtain an aluminum alloy whose oxidation resistance is improved to such an extent that a metallic luster is not lost even after heat treatment is conducted at about 600° C.

EXAMPLES

Hereinafter, the present invention will be described in more detail on the basis of Examples. However, the Examples are merely illustrative, and an aluminum alloy and a method for manufacturing the aluminum alloy according to the present invention are not limited thereto. The scope of the present invention is determined by appended claims and includes all modifications within the meaning and scope equivalent to those of the claims.

Example 1

-Electrolysis Step- (Molten Salt Bath)

Aluminum chloride ($AlCl_3$) and 1-ethyl-3-methylimidazolium chloride (EMIC) were mixed such that a mixing ratio of $AlCl_3$ to EMIC was 2:1 on a molar basis, and the resulting mixture was heated to 45° C. Subsequently, $ZrCl_4$ and 1,10-phenanthroline chloride monohydrate were added to the mixture such that the concentrations of $ZrCl_4$ and 1,10-phenanthroline chloride monohydrate were 0.002 mol/L and 0.3 g/L, respectively, to thereby prepare a molten salt bath 1.

(Substrate)

A SUS foil having a size of 5.0 cm×12.0 cm×0.3 mm t was prepared as a substrate.

(Molten Salt Electrolysis)

Aluminum alloy was electrodeposited on a surface of the substrate using the molten salt bath 1 prepared as described above. The substrate was connected on the cathode side of a rectifier, and an aluminum plate (purity 99.99%) acting as a counter electrode was connected on the anode side of the rectifier. The temperature of the molten salt bath 1 was controlled to 45° C., and the current density was controlled to 30 mA/cm2.

As a result, an aluminum alloy containing Zr and C was electrodeposited on the surface of the substrate.

(Separation)

The aluminum alloy electrodeposited on the surface of the substrate was separated to obtain an aluminum alloy 1 having a thickness of 15 μm.

Example 2

A molten salt bath 2 was prepared as in the molten salt bath 1 except that the concentration of $ZrCl_4$ was changed to 0.005 mol/L.

Subsequently, an aluminum alloy 2 was obtained as in Example 1 except that the molten salt bath 2 was used.

Example 3

A molten salt bath 3 was prepared as in the molten salt bath 1 except that the concentration of $ZrCl_4$ was changed to 0.012 mol/L.

Subsequently, an aluminum alloy 3 was obtained as in Example 1 except that the molten salt bath 3 was used.

Example 4

A molten salt bath 4 was prepared as in the molten salt bath 1 except that $CuCl_2$ was used instead of $ZrCl_4$ so as to have a concentration of 0.002 mol/L.

Subsequently, an aluminum alloy 4 was obtained as in Example 1 except that the molten salt bath 4 was used.

Example 5

A molten salt bath 5 was prepared as in the molten salt bath 4 except that the concentration of $CuCl_2$ was changed to 0.005 mol/L.

Subsequently, an aluminum alloy 5 was obtained as in Example 1 except that the molten salt bath 5 was used.

Example 6

A molten salt bath 6 was prepared as in the molten salt bath 4 except that the concentration of $CuCl_2$ was changed to 0.012 mol/L.

Subsequently, an aluminum alloy 6 was obtained as in Example 1 except that the molten salt bath 6 was used.

Example 7

A molten salt bath 7 was prepared as in the molten salt bath 2 except that the concentration of 1,10-phenanthroline chloride monohydrate was changed to 0.05 g/L.

Subsequently, an aluminum alloy 7 was obtained as in Example 1 except that the molten salt bath 7 was used.

Example 8

A molten salt bath 8 was prepared as in the molten salt bath 2 except that the concentration of 1,10-phenanthroline chloride monohydrate was changed to 1.5 g/L.

Subsequently, an aluminum alloy 8 was obtained as in Example 1 except that the molten salt bath 8 was used.

Comparative Example 1

A molten salt bath 9 was prepared as in the molten salt bath 1 except that the concentration of $ZrCl_4$ was changed to 0.0005 mol/L.

Subsequently, an aluminum alloy 9 was obtained as in Example 1 except that the molten salt bath 9 was used.

Comparative Example 2

A molten salt bath 10 was prepared as in the molten salt bath 1 except that the concentration of $ZrCl_4$ was changed to 0.021 mol/L.

Subsequently, an aluminum alloy 10 was obtained as in Example 1 except that the molten salt bath 10 was used.

Comparative Example 3

A molten salt bath 11 was prepared as in the molten salt bath 2 except that the concentration of 1,10-phenanthroline chloride monohydrate was changed to 0.01 g/L.

Subsequently, an aluminum alloy 11 was obtained as in Example 1 except that the molten salt bath 11 was used.

Comparative Example 4

A molten salt bath 12 was prepared as in the molten salt bath 2 except that the concentration of 1,10-phenanthroline chloride monohydrate was changed to 2.5 g/L.

Subsequently, an aluminum alloy 12 was obtained as in Example 1 except that the molten salt bath 12 was used.

Comparative Example 5

A molten salt bath 13 was prepared as in the molten salt bath 2 except that 1,10-phenanthroline chloride monohydrate was not added.

Subsequently, an aluminum alloy 13 was obtained as in Example 1 except that the molten salt bath 13 was used.

Comparative Example 6

A molten salt bath 14 was prepared as in the molten salt bath 5 except that 1,10-phenanthroline chloride monohydrate was not added.

Subsequently, an aluminum alloy 14 was obtained as in Example 1 except that the molten salt bath 14 was used.

Comparative Example 7

A molten salt bath 15 was prepared as in the molten salt bath 1 except that $ZrCl_4$ was not added.

Subsequently, aluminum A was obtained as in Example 1 except that the molten salt bath 15 was used.

Comparative Example 8

A molten salt bath 16 was prepared as in the molten salt bath 1 except that neither $ZrCl_4$ nor 1,10-phenanthroline chloride monohydrate was added.

Subsequently, aluminum B was obtained as in Example 1 except that the molten salt bath 16 was used.

—Evaluation—

(Determination of Element Contained)

The compositions of the aluminum alloys 1 to 14, the aluminum A, and the aluminum B were determined by inductively coupled plasma (ICP) emission spectroscopy. Table 1 shows the results.

(Change in Appearance by Heat Treatment)

The aluminum alloys 1 to 14, the aluminum A, and the aluminum B were subjected to heat treatment at 600° C. for one hour. The change in appearance before and after the heat treatment was examined by visual observation. Table 1 shows the results.

(Measurement of Arithmetic Mean Roughness Ra)

The arithmetic mean roughness Ra of a surface of each of the aluminum alloys 1 to 14, the aluminum A, and the aluminum B was measured with a laser microscope. Table 1 shows the results.

(Tensile Strength)

Each of the aluminum alloys 1 to 14, the aluminum A, and the aluminum B was separated from the substrate, and tensile strength thereof was measured by a tensile test. The shape of a specimen was designed to have a width of 20 mm, a length of 100 mm, and a gauge length of 60 mm.

Furthermore, the aluminum alloys 1 to 14, the aluminum A, and the aluminum B that were separated from the substrates were subjected to heat treatment at 600° C. for one hour and cooled to room temperature. Subsequently, a tensile test was conducted in the same manner to measure tensile strength. Table 1 shows the results.

TABLE 1

| | Molten salt bath | | | Aluminum alloy | | | Appearance | | Arithmetic | Tensile strength | |
|---|---|---|---|---|---|---|---|---|---|---|---|
| | Additive element-containing compound | | Smoothening agent | Additive element | | Carbon | Heat treatment at 600° C. for 1 hour | | mean roughness | Heat treatment at 600° C. for 1 hour | |
| | Type | Content (mol/L) | Content (g/L) | Type | Content (mass %) | Content (mass %) | Before | After | Ra (μm) | Before (MPa) | After (Mpa) |
| Aluminum alloy 1 | $ZrCl_4$ | 0.002 | 0.3 | Zr | 0.08 | 0.18 | Gloss | Gloss | 0.16 | 178 | 194 |
| Aluminum alloy 2 | $ZrCl_4$ | 0.005 | 0.3 | Zr | 1.1 | 0.21 | Gloss | Gloss | 0.18 | 193 | 199 |
| Aluminum alloy 3 | $ZrCl_4$ | 0.012 | 0.3 | Zr | 7.2 | 0.2 | Gloss | Gloss | 0.14 | 212 | 210 |
| Aluminum alio) 4 | $CuCl_2$ | 0.002 | 0.3 | Cu | 0.12 | 0.22 | Gloss | Gloss | 0.12 | 154 | 173 |
| Aluminum alloy 5 | $CuCl_2$ | 0.005 | 0.3 | Cu | 1.2 | 0.19 | Gloss | Gloss | 0.16 | 173 | 172 |
| Aluminum alloy 6 | $CuCl_2$ | 0.012 | 0.3 | Cu | 7.8 | 0.21 | Gloss | Gloss | 0.16 | 242 | 240 |
| Aluminum alloy 7 | $ZrCl_4$ | 0.005 | 0.05 | Zr | 1.1 | 0.05 | Gloss | Gloss | 0.2 | 170 | 160 |
| Aluminum alloy 8 | $ZrCl_4$ | 0.005 | 1.5 | Zr | 1.1 | 8.2 | Gloss | Gloss | 0.09 | 244 | 224 |
| Aluminum alloy 9 | $ZrCl_4$ | 0.0005 | 0.3 | Zr | 0.007 | 0.2 | Gloss | Gloss | 0.23 | 154 | 93 |
| Aluminum alloy 10 | $ZrCl_4$ | 0.021 | 0.3 | Zr | 12.4 | 0.2 | Gloss | Gloss | 0.08 | 80 | 41 |
| Aluminum alloy 11 | $ZrCl_4$ | 0.005 | 0.01 | Zr | 1.1 | 0.004 | Gloss | Gloss | 0.34 | 194 | 130 |
| Aluminum alloy 12 | $ZrCl_4$ | 0.005 | 2.5 | Zr | 1.1 | 12.9 | Gloss | Gloss | 0.08 | 60 | 21 |
| Aluminum alloy 13 | $ZrCl_4$ | 0.005 | 0 | Zr | 1.1 | 0 | White | Brown | 0.98 | 200 | 150 |
| Aluminum alloy 14 | $CuCl_2$ | 0.005 | 0 | Cu | 1.2 | 0 | White | Brown | 0.72 | 154 | 71 |
| Aluminum A | — | — | 0.3 | — | — | 0.22 | Gloss | Gloss | 0.2 | 182 | 92 |
| Aluminum B | — | — | — | — | — | — | White | Brown | 0.48 | 120 | 51 |

(Measurement of Thickness of Oxide Film)

The aluminum alloy 1 and the aluminum B were each subjected to X-ray photoelectron spectroscopy to measure the thickness of an oxide film. According to the results, it was confirmed that the thickness of the oxide film of the aluminum alloy 1 was 8 nm, which was smaller than the thickness of the oxide film of the aluminum B by about 10 nm.

The invention claimed is:

1. An aluminum alloy comprising at least one additive element selected from the group consisting of Zr and Cu, the total amount of the additive elements being 0.010% by mass or more and 8.0% by mass or less; and C in an amount of 0.01% by mass or more and 10.0% by mass or less, the balance being Al and inevitable impurities, wherein the aluminum alloy has a surface having an arithmetic mean roughness Ra of 0.20 μm or less.

2. An aluminum alloy comprising at least one additive element selected from the group consisting of Zr and Cu, the total amount of the additive elements being 0.010% by mass or more and 8.0% by mass or less; and C in an amount of 0.01% by mass or more and 10.0% by mass or less, the balance being Al and inevitable impurities, wherein the aluminum alloy has a foil shape having a thickness of 3 μm or more and 40 μm or less.

3. An aluminum alloy comprising at least one additive element selected from the group consisting of Zr and Cu, the total amount of the additive elements being 0.010% by mass or more and 8.0% by mass or less; and C in an amount of 0.01% by mass or more and 10.0% by mass or less, the balance being Al and inevitable impurities, wherein the aluminum alloy has a three-dimensional network structure.

* * * * *